US010704423B2

(12) United States Patent
Nanda et al.

(10) Patent No.: US 10,704,423 B2
(45) Date of Patent: Jul. 7, 2020

(54) DIFFUSER FOR A TURBINE ENGINE AND METHOD OF FORMING SAME

(71) Applicant: General Electric Company, Schenectady, NY (US)

(72) Inventors: Deepesh D. Nanda, Bangalore (IN); Robert Jacek Zreda, Warsaw (PL); Daniel Tomasz Ozga, Warsaw (PL)

(73) Assignee: General Electric Company, Schenectady, NY (US)

( * ) Notice: Subject to any disclaimer, the term of this patent is extended or adjusted under 35 U.S.C. 154(b) by 67 days.

(21) Appl. No.: 15/744,182

(22) PCT Filed: Aug. 12, 2015

(86) PCT No.: PCT/PL2015/050033
§ 371 (c)(1),
(2) Date: Jan. 12, 2018

(87) PCT Pub. No.: WO2070/026904
PCT Pub. Date: Feb. 16, 2017

(65) Prior Publication Data

US 2018/0202319 A1 Jul. 19, 2018

(51) Int. Cl.
*F01D 25/30* (2006.01)

(52) U.S. Cl.
CPC ..... *F01D 25/30* (2013.01); *F05D 2210/42* (2013.01); *F05D 2230/80* (2013.01);
(Continued)

(58) Field of Classification Search
CPC ..... F01D 25/30; F01D 9/04; F05D 2250/73; F05D 2230/80; F04D 29/44;
(Continued)

(56) References Cited

U.S. PATENT DOCUMENTS 3,289,921 A * 12/1966 Soo ..... F04D 29/441 415/207
3,625,630 A * 12/1971 Soo ..... F01D 25/30 415/207

(Continued)

FOREIGN PATENT DOCUMENTS

DE 10 2011 055 376 A1 5/2012
EP 2 639 404 A1 9/2013

(Continued)

OTHER PUBLICATIONS

Ch. Musch, H, Stuer and G. Hermle "Optimization Strategy for a Coupled Design of the Last Stage and the Successive Diffuser in a Low Pressure Environment" Proceedings of ASME Turbo Expo 2011, Jun. 6-10, 2011 in Vancouver BC, Ca. (Year: 2011).*

(Continued)

*Primary Examiner* — Michael Lebentritt
*Assistant Examiner* — Topaz L. Elliott
(74) *Attorney, Agent, or Firm* — Armstrong Teasdale LLP

(57) ABSTRACT

A diffuser for a turbine engine includes a first wall that extends circumferentially about a centerline axis of the turbine engine. The diffuser also includes a second wall that extends circumferentially about the centerline axis. At least a portion of the second wall is positioned radially outwardly from at least a portion of the first wall. A flow path is defined by the first wall and the second wall. The flow path extends from an inlet configured to receive an axial flow of a fluid, to a circumferentially extending outlet configured to emit the fluid in a substantially radial direction. The outlet extends asymmetrically about the centerline axis.

20 Claims, 4 Drawing Sheets

(52) U.S. Cl.
CPC .... *F05D 2250/14* (2013.01); *F05D 2250/323* (2013.01); *F05D 2250/324* (2013.01); *F05D 2250/38* (2013.01); *F05D 2250/71* (2013.01); *F05D 2250/73* (2013.01)

(58) Field of Classification Search
CPC ..... F04D 29/444; F04D 29/54; F04D 29/541; F04D 29/545; F04D 29/547
See application file for complete search history.

(56) References Cited

U.S. PATENT DOCUMENTS

| | | | | |
|---|---|---|---|---|
| 3,986,687 | A | 10/1976 | Beavers et al. | |
| 4,315,715 | A * | 2/1982 | Nishiguchi | F01D 9/00 138/37 |
| 5,203,674 | A | 4/1993 | Vinciguerra | |
| 5,257,906 | A * | 11/1993 | Gray | F01D 25/30 415/226 |
| 6,382,912 | B1 | 5/2002 | Lee et al. | |
| 9,249,687 | B2 * | 2/2016 | Nanda | F01D 11/08 |
| 9,644,497 | B2 * | 5/2017 | Salunkhe | F01D 25/30 |
| 2012/0034064 | A1 | 2/2012 | Nanda et al. | |
| 2012/0102956 | A1 * | 5/2012 | Nanda | F01D 11/08 60/722 |
| 2012/0121405 | A1 | 5/2012 | Slepsiki et al. | |
| 2014/0026999 | A1 | 1/2014 | Frailich et al. | |
| 2014/0047813 | A1 * | 2/2014 | Frailich | F01D 25/30 60/39.5 |
| 2014/0348647 | A1 | 11/2014 | Stang et al. | |
| 2015/0143813 | A1 * | 5/2015 | Salunkhe | F01D 25/30 60/796 |
| 2017/0198608 | A1 * | 7/2017 | Ono | F01D 5/02 |

FOREIGN PATENT DOCUMENTS

| | | | | |
|---|---|---|---|---|
| JP | 3776580 | B2 * | 5/2006 | |
| JP | 3776580 | B2 | 5/2006 | |
| JP | 2006283587 | A * | 10/2006 | |
| WO | WO-2019131632 | A1 * | 7/2019 | F02C 7/00 |

OTHER PUBLICATIONS

International Search Report and Written Opinion issued in connection with corresponding PCT Application No. PCT/PL2015/050033 dated Apr. 6, 2016.

International Preliminary Report on Patentability issued in connection with corresponding PCT Application Na PCT/PL2015/050033 dated Feb. 13, 2018.

* cited by examiner

DIFFUSER FOR A TURBINE ENGINE AND METHOD OF FORMING SAME

BACKGROUND

The field of the disclosure relates generally to turbine engines, and more particularly to diffusers for turbine engines.

At least some known turbine engines include stages of turbine blades that extract energy from a flow of fluid. At least some known turbine engines include diffusers that receive fluid exhausted in an axial direction from the turbine stages. At least some such diffusers transition the exhausted fluid flow to a radial direction to facilitate reducing a velocity of the exhausted fluid flow and efficiently recovering a static pressure of the fluid. Moreover, at least some such diffusers include turning vanes disposed circumferentially across the fluid flow path to facilitate the axial-to-radial flow transition. For example, an outer surface of each turning vane transitions from a generally axially extending leading edge, along a curved surface, to a generally radially extending trailing edge. Such turning vanes facilitate transitioning the axial exhaust fluid flow to a radial direction while facilitating recovery of static pressure. However, at least some known turning vanes are susceptible to cracking and surface erosion, resulting in decreased diffuser efficiency and increased inspection, maintenance, and replacement costs for the diffuser. In addition, attempts to design or retrofit an improved diffuser are limited in at least some cases by a predefined available footprint for the diffuser and/or the turbine engine.

BRIEF DESCRIPTION

In one aspect, a diffuser for a turbine engine is provided. The diffuser includes a first wall that extends circumferentially about a centerline axis of the turbine engine. The diffuser also includes a second wall that extends circumferentially about the centerline axis. At least a portion of the second wall is positioned radially outwardly from at least a portion of the first wall. A flow path is defined by the first wall and the second wall. The flow path extends from an inlet configured to receive an axial flow of a fluid, to a circumferentially extending outlet configured to emit the fluid in a substantially radial direction. The outlet extends asymmetrically about the centerline axis.

In another aspect, a turbine engine is provided. The turbine engine includes a turbine section configured to exhaust a fluid. The turbine section defines a centerline axis. The turbine engine also includes an exhaust section coupled downstream from the turbine section. The exhaust section includes a diffuser. The diffuser includes a first wall that extends circumferentially about the centerline axis, and a second wall that extends circumferentially about the centerline axis. At least a portion of the second wall is positioned radially outwardly from at least a portion of the first wall. A flow path is defined by the first wall and the second wall. The flow path extends from an inlet configured to receive an axial flow of the fluid, to a circumferentially extending outlet configured to emit the fluid in a substantially radial direction. The outlet extends asymmetrically about the centerline axis.

In another aspect, a method of forming a diffuser for a turbine engine is provided. The method includes disposing a first wall circumferentially about a centerline axis of the turbine engine, and disposing a second wall circumferentially about the centerline axis. The method also includes positioning at least a portion of the second wall radially outwardly from at least a portion of the first wall, such that a flow path is defined by the first wall and the second wall. The flow path extends from an inlet configured to receive an axial flow of a fluid, to a circumferentially extending outlet configured to emit the fluid in a substantially radial direction. The outlet extends asymmetrically about the centerline axis.

DETAILED DESCRIPTION

The exemplary components and methods described herein overcome at least some of the disadvantages associated with known diffusers for turbine engines. The embodiments described herein include a diffuser that includes a radially directed outlet. The radially directed outlet is asymmetric about a centerline axis of the turbine engine. In some embodiments described herein, the diffuser also includes at least one axial diffuser section proximate an inlet of the diffuser.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

Figure 1:
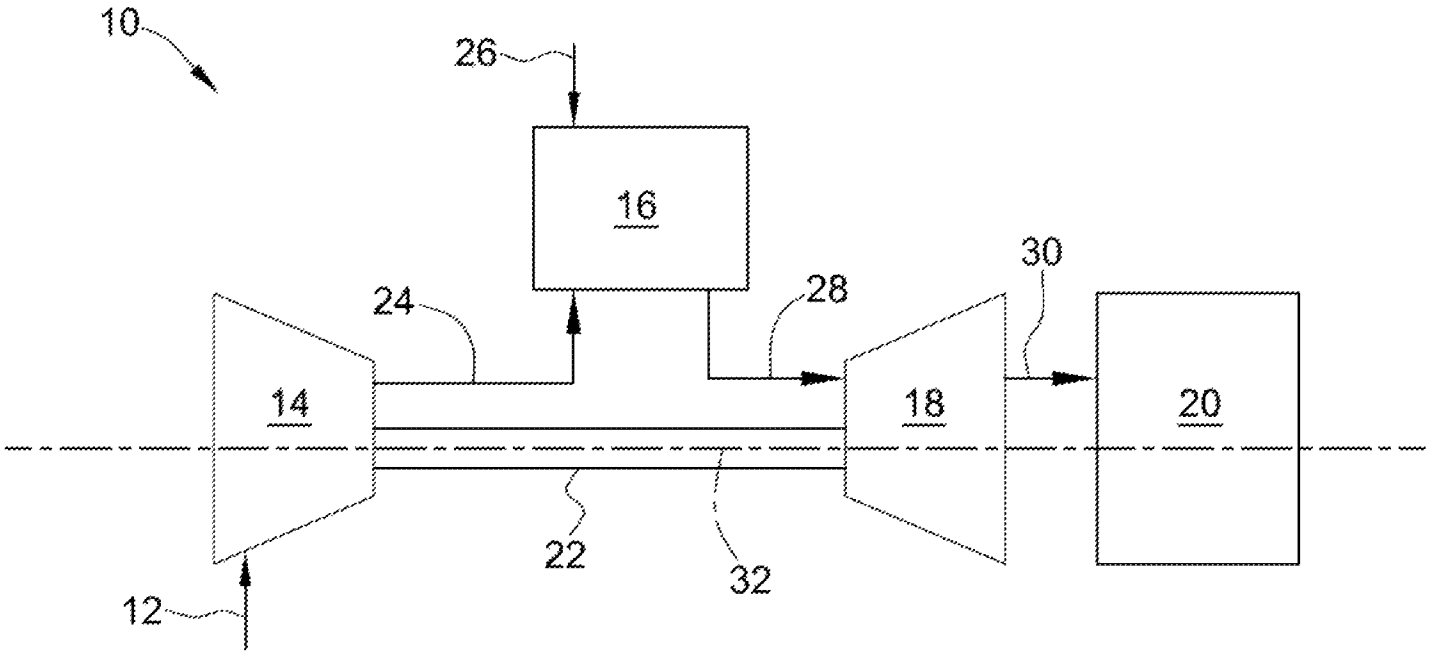
FIG. 1 is a schematic diagram of an exemplary embodiment of a turbine engine.

FIG. 1 is a schematic diagram of an exemplary turbine engine 10 with which embodiments of the turbine components of the current disclosure may be used. In the exemplary embodiment, turbine engine 10 is a gas turbine that includes a compressor section 14, a combustor section 16 coupled downstream from compressor section 14, a turbine section 18 coupled downstream from combustor section 16, and an exhaust section 20 coupled downstream from turbine section 18.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components. Rotor shaft 22 defines a centerline axis 32 of gas turbine 10. Unless otherwise stated, the term "axially" refers to a direction parallel to centerline axis 32, and the term "radially" refers to a direction radially outward from centerline axis 32.

During operation of gas turbine 10, compressor section 14 receives an air flow 12. Compressor section 14 converts mechanical rotational energy from rotor shaft 22 to compress air flow 12 to a higher pressure and temperature. Compressor section 14 discharges a flow of compressed air 24 to combustor section 16. In combustor section 16, compressed air 24 is mixed with a flow of fuel 26 and ignited to generate combustion gases 28 that are channeled towards turbine section 18. Turbine section 18 converts thermal energy from combustion gases 28 to mechanical rotational energy of rotor shaft 22. Rotor shaft 22 may be coupled to a load (not shown) such as, but not limited to, an electrical generator and/or a mechanical drive application. Turbine section 18 emits a flow of exhausted combustion gases 30 downstream into exhaust section 20.

Figure 2:
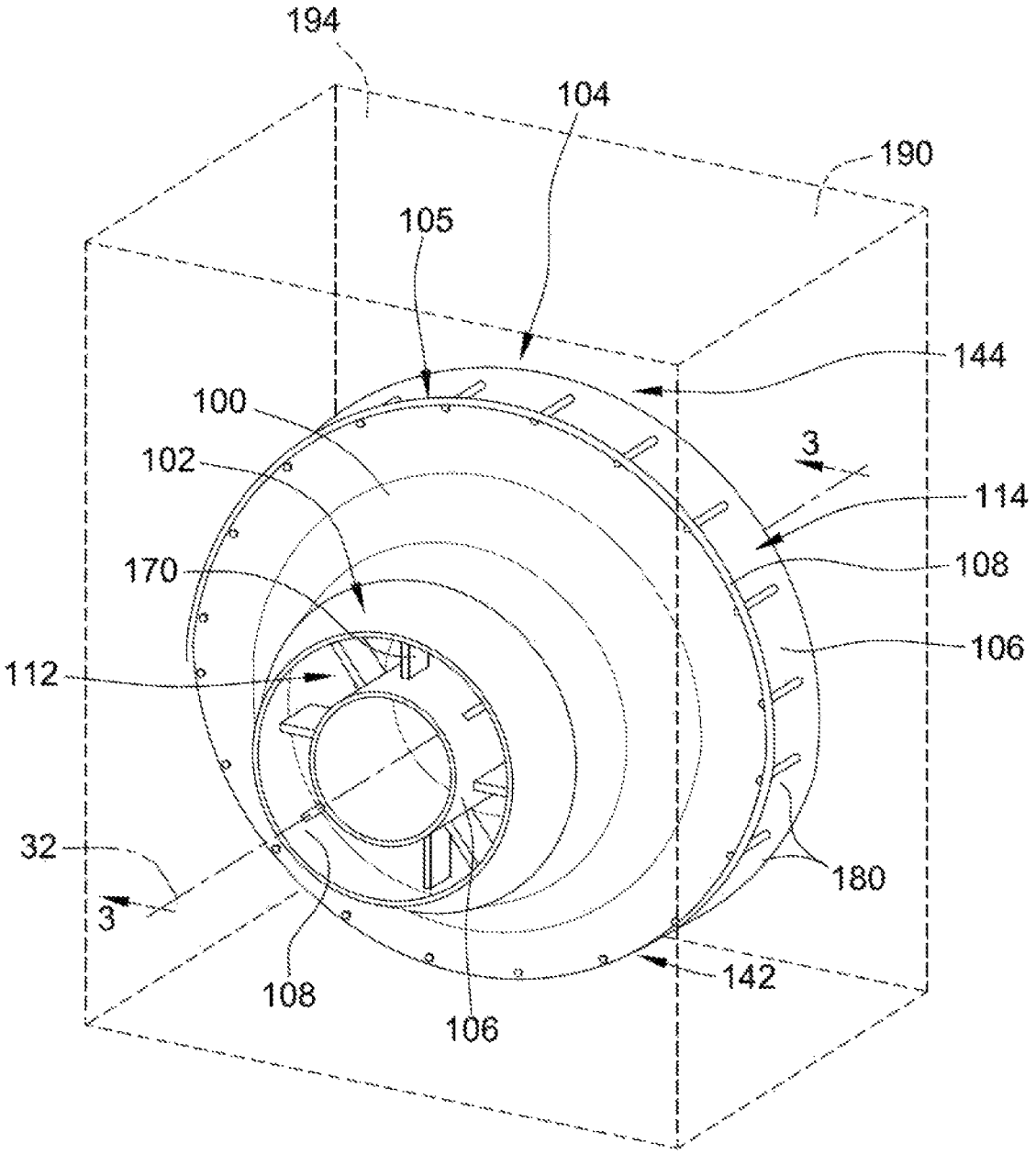
FIG. 2 is a schematic perspective view of an exemplary embodiment of a diffuser that may be used with the gas turbine shown in FIG. 1.
Figure 3:
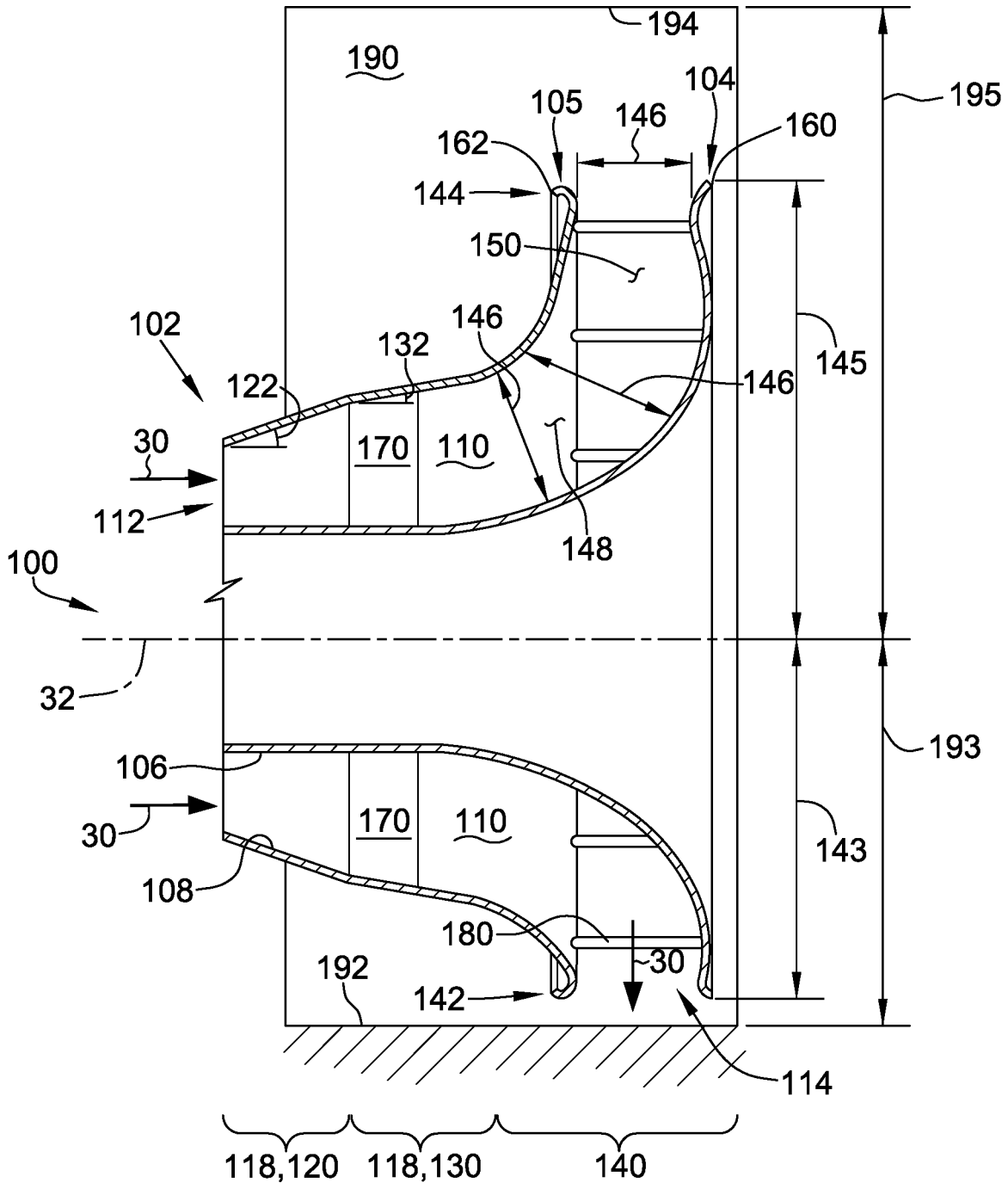
FIG. 3 is a schematic section view of the exemplary diffuser shown in FIG. 2, taken along lines 3-3 shown in FIG. 2.

FIG. 2 is a schematic perspective view of an exemplary embodiment of a diffuser 100 that may be included within exhaust section 20 of gas turbine 10. FIG. 3 is a schematic section view of diffuser 100 taken along lines 3-3 shown in FIG. 2. With reference to FIGS. 1-3, diffuser 100 extends axially from a first axial end 102 to a second axial end 104. Diffuser 100 includes a first wall 106 that extends between first axial end 102 and second axial end 104. First wall 106 also extends circumferentially about centerline axis 32. In the exemplary embodiment, first wall 106 extends substantially 360 degrees about centerline axis 32. In alternative embodiments, first wall 106 extends less than 360 degrees about centerline axis 32. In the exemplary embodiment, first wall 106 is asymmetric about centerline axis 32. In alternative embodiments, first wall 106 is substantially symmetric about centerline axis 32.

Diffuser 100 also includes a second wall 108 that extends between first axial end 102 of diffuser 100 and a second axial end 105. Second axial end 105 is disposed axially between first axial end 102 and second axial end 104 of diffuser 100. Second wall 108 also extends circumferentially about centerline axis 32, and at least a portion of second wall 108 is positioned radially outwardly from at least a portion of first wall 106. In the exemplary embodiment, second wall 108 extends substantially 360 degrees about centerline axis 32. In alternative embodiments, second wall 108 extends less than 360 degrees about centerline axis 32. In the exemplary embodiment, second wall 108 is asymmetric about centerline axis 32. In alternative embodiments, second wall 108 is substantially symmetric about centerline axis 32. Each of first wall 106 and second wall 108 is formed from any suitable number and configuration of components that enables diffuser 100 to function as described herein.

A flow path 110 is defined by, and extends between, first wall 106 and second wall 108. Flow path 110 extends from a substantially annular inlet 112, defined at diffuser first axial end 102, to a circumferentially extending outlet 114, defined between second axial end 105 of second wall 108 and diffuser second axial end 104. In the exemplary embodiment, each of inlet 112 and outlet 114 extends substantially 360 degrees about centerline axis 32. In alternative embodiments, at least one of inlet 112 and outlet 114 extends less than 360 degrees about centerline axis 32. Inlet 112 is configured to receive a substantially axial flow of fluid, such as exhausted gases 30 from turbine section 18, and outlet 114 is configured to emit the fluid from flow path 110 in a substantially radial flow. In the exemplary embodiment, outlet 114 is asymmetric about centerline axis 32. In alternative embodiments, outlet 114 is substantially symmetric about centerline axis 32.

In the exemplary embodiment, diffuser 100 is disposed at least partially within an exhaust plenum 190. Exhaust plenum 190 is in flow communication with outlet 114, such that exhaust plenum 190 is configured to receive exhaust gases 30 from diffuser 100. In certain embodiments, exhaust plenum 190 routes exhaust gases 30 to a heat recovery steam generator (not shown). Exhaust plenum 190 is illustrated in hidden lines in FIG. 2 to enable a better view of diffuser 100. Although exhaust plenum 190 is illustrated as having a generally box-like shape, in alternative embodiments exhaust plenum 190 has any suitable shape that enables turbine engine 10 to function as described herein. In some embodiments, a predetermined size of exhaust plenum 190 imposes a size constraint on diffuser 100.

First wall 106 and second wall 108 are configured to cooperate between inlet 112 and outlet 114 to transition the flow of exhausted gases 30 from the axial direction to the radial direction with an efficient pressure recovery, and without a need for turning vanes disposed within flow path 110. In some embodiments, radially directed outlet 114 defined asymmetrically about centerline axis 32 facilitates the efficient pressure recovery without turning vanes. In alternative embodiments, turning vanes (not shown) additionally are included.

For example, in certain embodiments, first wall 106 and second wall 108 cooperate to form at least one axial diffuser section 118 proximate inlet 112, and a radial diffuser section 140 disposed downstream from the at least one axial diffuser section 118 and proximate outlet 114. In the exemplary embodiment, the at least one axial diffuser section 118 includes a first axial diffuser section 120 and a second axial diffuser section 130 disposed downstream from first axial diffuser section 120. Radial diffuser section 140 is disposed downstream from second axial diffuser section 130.

In the exemplary embodiment, each of first axial diffuser section 120 and second axial diffuser section 130 is substantially symmetric about centerline axis 32. More specifically, first wall 106 extends substantially parallel to centerline axis 32 along first axial diffuser section 120 and along second axial diffuser section 130. Second wall 108 extends radially outward along first axial diffuser section 120 at a first angle 122 with respect to centerline axis 32, and extends radially outward along second axial diffuser section 130 at a second angle 132 with respect to centerline axis 32, such that second angle 132 is less than first angle 122. For example, in certain embodiments, efficient pressure recovery is facilitated by first angle 122 in a range of about 10 to 35 degrees, and in particular embodiments, with first angle 122 in a range of about 15 to 25 degrees. In the exemplary embodiment, first angle 122 is about 16 degrees. In addition, in certain embodiments, efficient pressure recovery is facilitated by second angle 132 in a range of about 30 percent to about 70 percent of first angle 122, and in particular embodiments, with second angle 132 about half of first angle 122. In the exemplary embodiment, second angle 132 is about 8 degrees. In alternative embodiments, each of first angle 122 and second angle 132 has any suitable value that enables diffuser 100 to function as described herein. In other alternative embodiments, at least one of first axial diffuser section 120 and second axial diffuser section 130 is asymmetric about centerline axis 32. In still other alternative embodiments, diffuser 100 does not include second axial diffuser section 130.

In the exemplary embodiment, radial diffuser section 140 is substantially asymmetric about centerline axis 32. In certain embodiments, the asymmetry of radial diffuser section 140 enables diffuser 100 to obtain an improved pressure recovery efficiency within the size constraint imposed by exhaust plenum 190.

For example, in the exemplary embodiment, radial diffuser section 140 extends radially from a first radial end 142 to a circumferentially opposite second radial end 144. First radial end 142 is positioned generally adjacent a corresponding first wall 192 of exhaust plenum 190, and second radial end is positioned generally adjacent a corresponding opposite second wall 194 of exhaust plenum 190. First radial end 142 is disposed at a first distance 143 from centerline axis 32, and first distance 143 is less than a distance 193 between first wall 192 and centerline axis 32, such that diffuser 100 is accommodated within exhaust plenum 190. However, a distance 195 between second wall 194 of exhaust plenum 190 and centerline axis 32 is substantially greater than distance 193. In certain embodiments, second radial end 144 of radial diffuser section 140 is disposed at a second distance 145 from centerline axis 32 that is greater than first distance 143. In some such embodiments, an improved pressure recovery efficiency is obtained from diffuser 100, as compared to a performance of a radial diffuser section that is symmetric about centerline axis 32, while still enabling diffuser 100 to be accommodated within exhaust plenum 190. For example, but not by way of limitation, second distance 145 being greater than first distance 143 facilitates a reduced flow separation at outlet 114 proximate second radial end 144.

In the illustrated embodiment, first radial end 142 is a bottom end of radial diffuser section 140, and second radial end 144 is a circumferentially opposite top end of radial diffuser section 140. In alternative embodiments, first radial end 142 and second radial end 144 are any two generally circumferentially opposite radial ends of radial diffuser section 140, such as, but not limited to, a left end and a circumferentially opposing right end of radial diffuser section 140. In some embodiments, a circumferential position of first radial end 142 and second radial end 144 is selected based at least partially upon a shape of exhaust plenum 190.

In the exemplary embodiment, first wall 106 and second wall 108 are configured to diverge from each other within an upstream portion 148 of radial diffuser section 140, and to converge with each other within a downstream portion 150 of radial diffuser section 140. More specifically, a distance 146 between first wall 106 and second wall 108, measured normal to flow path 110, increases along upstream portion 148 and decreases along downstream portion 150. In certain embodiments, the divergence of first wall 106 and second wall 108 within upstream portion 148 of radial diffuser section 140 facilitates further expansion of exhaust gases 30 by diffuser 100, while the convergence of first wall 106 and second wall 108 within downstream portion 150 of radial diffuser section 140 functions as a "vortex trap" that facilitates decreased production of vortices adjacent outlet 114, and thus improves a pressure recovery efficiency of diffuser 100.

In the exemplary embodiment, each of upstream portion 148 and downstream portion 150 extends substantially 360 degrees about centerline axis 32. In alternative embodiments, at least one of upstream portion 148 and downstream portion 150 extends less than 360 degrees about centerline axis 32. In other alternative embodiments, radial diffuser section 140 does not include at least one of upstream portion 148 and downstream portion 150.

In the exemplary embodiment, first wall 106 and second wall 108 are spaced apart radially within the at least one axial diffuser section 118 by a plurality of first struts 170 spaced circumferentially about centerline axis 32. More specifically, each first strut 170 extends from first wall 106 to second wall 108 in a substantially radial direction. In the exemplary embodiment, each first strut 170 defines a thin, streamlined circumferential profile configured to reduce flow separation of exhausted gases 30 within the at least one axial diffuser section 118. For example, each first strut 170 has a symmetric airfoil cross-section in a plane normal to the radial direction. In alternative embodiments, each first strut 170 has any suitable shape that enables diffuser 100 to function as described herein. In other alternative embodiments, diffuser 100 does not include first struts 170.

In the exemplary embodiment, first wall 106 and second wall 108 are spaced apart axially within radial diffuser section 140 by a plurality of second struts 180 spaced circumferentially about centerline axis 32. More specifically, each second strut 180 extends from first wall 106 to second wall 108 in a substantially axial direction. In the exemplary embodiment, each second strut 180 defines a thin, streamlined circumferential profile configured to reduce flow separation of exhausted gases 30 along flow path 110. For example, each second strut 180 is a thin rod. In alternative embodiments, each second strut 180 has any suitable shape that enables diffuser 100 to function as described herein. In other alternative embodiments, diffuser 100 does not include second struts 180.

Figure 4:
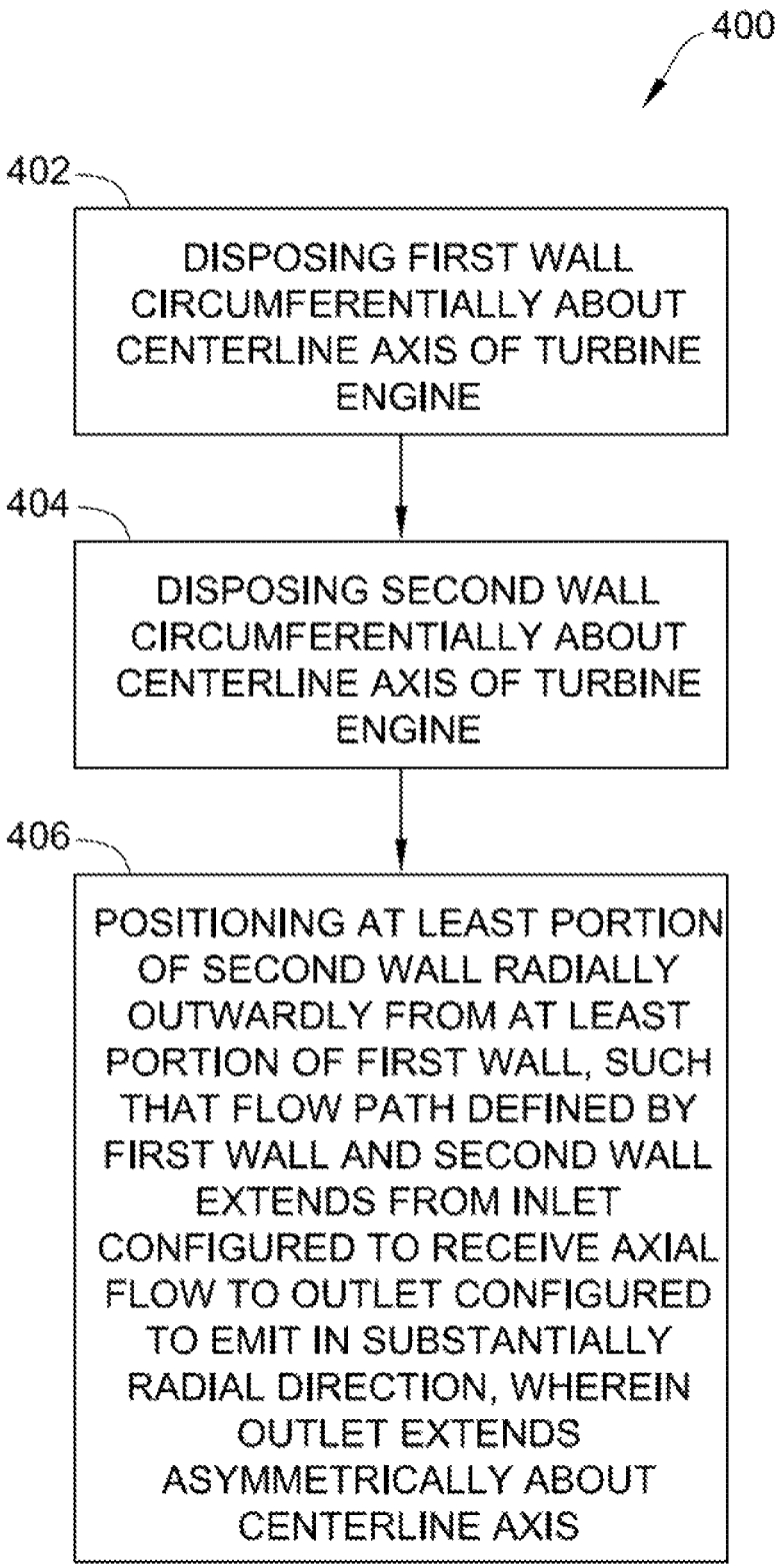
FIG. 4 is a flow diagram of an exemplary method of forming a diffuser, such as the exemplary diffuser shown in FIGS. 2 and 3, for a turbine engine, such as the exemplary turbine engine shown in FIG. 1.

An exemplary method 400 of forming a diffuser, such as diffuser 100, for a turbine engine, such as gas turbine 10, is illustrated in a flow chart in FIG. 4. With reference also to FIGS. 1-3, exemplary method 400 includes disposing 402 a first wall, such as first wall 106, circumferentially about a centerline axis, such as centerline axis 32, of the turbine engine. Method 400 also includes disposing 404 a second wall, such as second wall 108, circumferentially about the centerline axis. Method 400 further includes positioning 406 at least a portion of the second wall radially outwardly from at least a portion of the first wall, such that a flow path, such as flow path 110, is defined by the first wall and the second wall. The flow path extends from an inlet, such as inlet 112, configured to receive an axial flow of a fluid, such as exhausted gas 30, to a circumferentially extending outlet, such as outlet 114, configured to emit the fluid in a substantially radial direction. The outlet extends asymmetrically about the centerline axis.

Exemplary embodiments of a diffuser that includes an asymmetric radially directed outlet, and a method for forming the diffuser, are described above in detail. The embodiments provide an advantage in facilitating an efficient static pressure recovery without a need for circumferentially extending turning vanes, thus reducing inspection, maintenance, and replacement costs for the diffuser. The embodiments also provide an advantage by facilitating efficient static pressure recovery while satisfying a size constraint imposed by an exhaust section of a turbine engine.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

While the disclosure has been described in terms of various specific embodiments, those skilled in the art will recognize that the disclosure can be practiced with modification within the spirit and scope of the claims. Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

What is claimed is:

1. A diffuser for a turbine engine, said diffuser comprising:

a first wall that extends circumferentially about a centerline axis of the turbine engine;

a second wall that extends circumferentially about the centerline axis, at least a portion of said second wall positioned radially outwardly from at least a portion of said first wall, wherein a perimeter of said first wall and a perimeter of said second wall each are oriented in a respective plane perpendicular to the centerline axis and define an oval shape extending from a first radial end to a circumferentially opposite second radial end, said first radial end is disposed at a first distance from the centerline axis, said second radial end is disposed at a second distance from the centerline axis that is greater than the first distance; and a flow path defined by said first wall and said second wall, said flow path extends from an inlet configured to receive an axial flow of a fluid to a circumferentially extending outlet, wherein said outlet is defined by said perimeter of said first wall and said perimeter of said second wall and is configured to emit the fluid in a substantially radial direction, wherein said outlet extends asymmetrically about the centerline axis.

2. The diffuser of claim 1, wherein said first wall and said second wall cooperate to form a radial diffuser section proximate said outlet, and wherein said first wall and said second wall diverge from each other within an upstream portion of said radial diffuser section.

3. The diffuser of claim 2, wherein said first wall and said second wall converge with each other within a downstream portion of said radial diffuser section.

4. The diffuser of claim 1, wherein said perimeter of said first wall is spaced at a constant distance from said perimeter of said second wall around a circumference of said outlet.

5. The diffuser of claim 1, wherein said first radial end is a bottom end of said perimeter of said first wall and said perimeter of said second wall, and said second radial end is a circumferentially opposite top end of said perimeter of said first wall and said perimeter of said second wall.

6. The diffuser of claim 1, wherein said first wall and said second wall cooperate to form at least one axial diffuser section proximate said inlet, and said at least one axial diffuser section is substantially symmetric about the centerline axis.

7. The diffuser of claim 1, wherein said at least one axial diffuser section comprises a first axial diffuser section and a second axial diffuser section disposed downstream from said first axial diffuser section, and wherein:

said first wall extends substantially parallel to the centerline axis along said first axial diffuser section and said second axial diffuser section, said second wall extends radially outward along said first axial diffuser section at a first angle with respect to the centerline axis, and said second wall extends radially outward along said second axial diffuser section at a second angle with respect to the centerline axis, such that the second angle is less than the first angle.

8. The diffuser of claim 7, wherein the second angle is in a range of about 30 percent to about 70 percent of the first angle.

9. A turbine engine comprising:

a turbine section configured to exhaust a fluid, the turbine section defining a centerline axis; and an exhaust section coupled downstream from said turbine section, said exhaust section comprising a diffuser comprising:

a first wall that extends circumferentially about said centerline axis;

a second wall that extends circumferentially about said centerline axis, at least a portion of said second wall positioned radially outwardly from at least a portion of said first wall, wherein a perimeter of said first wall and a perimeter of said second wall each are oriented in a respective plane perpendicular to the centerline axis and define an oval shape extending from a first radial end to a circumferentially opposite second radial end, said first radial end is disposed at a first distance from the centerline axis, said second radial end is disposed at a second distance from the centerline axis that is greater than the first distance; and a flow path defined by said first wall and said second wall, said flow path extends from an inlet configured to receive an axial flow of the fluid to a circumferentially extending outlet, wherein said outlet is defined by said perimeter of said first wall and said perimeter of said second wall and is configured to emit the fluid in a substantially radial direction, wherein said outlet extends asymmetrically about said centerline axis.

10. The turbine engine of claim 9, wherein said first wall and said second wall cooperate to form a radial diffuser section proximate said outlet, and wherein said first wall and said second wall diverge from each other within an upstream portion of said radial diffuser section.

11. The turbine engine of claim 10, wherein said first wall and said second wall converge with each other within a downstream portion of said radial diffuser section.

12. The turbine engine of claim 9, wherein said perimeter of said first wall is spaced at a constant distance from said perimeter of said second wall around a circumference of said outlet.

13. The turbine engine of claim 9, wherein said first radial end is a bottom end of said perimeter of said first wall and said perimeter of said second wall, and said second radial end is a circumferentially opposite top end of said perimeter of said first wall and said perimeter of said second wall.

14. The turbine engine of claim 9, wherein said first wall and said second wall cooperate to form at least one axial diffuser section proximate said inlet, said at least one axial diffuser section is substantially symmetric about said centerline axis.

15. The turbine engine of claim 9, wherein said at least one axial diffuser section comprises a first axial diffuser section and a second axial diffuser section disposed downstream from said first axial diffuser section, and wherein:

said first wall extends substantially parallel to said centerline axis along said first axial diffuser section and said second axial diffuser section, said second wall extends radially outward along said first axial diffuser section at a first angle with respect to said centerline axis, and said second wall extends radially outward along said second axial diffuser section at a second angle with respect to said centerline axis, such that the second angle is less than the first angle.

16. The turbine engine of claim 15, wherein the second angle is in a range of about 30 percent to about 70 percent of the first angle.

17. A method of forming a diffuser for a turbine engine, said method comprising:

disposing a first wall circumferentially about a centerline axis of the turbine engine; and disposing a second wall circumferentially about the centerline axis, wherein a perimeter of the first wall and a perimeter of the second wall each are oriented in a respective plane perpendicular to the centerline axis and define an oval shape extending from a first radial end to a circumferentially opposite second radial end, the first radial end is disposed at a first distance from the centerline axis, the second radial end is disposed at a second distance from the centerline axis that is greater than the first distance; and positioning at least a portion of the second wall radially outwardly from at least a portion of the first wall, such that a flow path is defined by the first wall and the second wall, wherein the flow path extends from an inlet configured to receive an axial flow of a fluid to a circumferentially extending outlet, wherein the outlet is defined by the perimeter of the first wall and the perimeter of the second wall and is configured to emit the fluid in a substantially radial direction, wherein the outlet extends asymmetrically about the centerline axis.

18. The method of claim 17, further comprising positioning the first wall and the second wall in cooperation to form a radial diffuser section proximate the outlet, such that the first wall and the second wall diverge from each other within an upstream portion of the radial diffuser section.

19. The method of claim 18, wherein said positioning the first wall and the second wall in cooperation to form the radial diffuser section further comprises positioning the first wall and the second wall to converge with each other within a downstream portion of the radial diffuser section.

20. The method of claim 17, further comprising positioning the first wall and the second wall in cooperation to form at least one axial diffuser section proximate the inlet, wherein the at least one axial diffuser section is substantially symmetric about the centerline axis.

* * * * *